US011059003B2

(12) United States Patent
York et al.

(10) Patent No.: US 11,059,003 B2
(45) Date of Patent: Jul. 13, 2021

(54) METHOD FOR PROVIDING BRINE

(71) Applicant: Intrepid Potash, Inc., Denver, CO (US)

(72) Inventors: Rick York, Moab, UT (US); Frank Martorana, Denver, CO (US); James Hanson, Crawford, CO (US)

(73) Assignee: Intrepid Potash, Inc., Denver, CO (US)

( * ) Notice: Subject to any disclaimer, the term of this patent is extended or adjusted under 35 U.S.C. 154(b) by 0 days.

(21) Appl. No.: 16/372,203

(22) Filed: Apr. 1, 2019

(65) Prior Publication Data

US 2019/0308146 A1 Oct. 10, 2019

Related U.S. Application Data

(60) Provisional application No. 62/655,609, filed on Apr. 10, 2018.

(51) Int. Cl.

| | |
|---|---|
| ***E21B 43/26*** | (2006.01) |
| ***B01F 5/10*** | (2006.01) |
| ***B01F 13/00*** | (2006.01) |
| ***B01F 15/02*** | (2006.01) |
| ***B01F 1/00*** | (2006.01) |

(52) U.S. Cl.

CPC ..... *B01F 5/10* (2013.01); *B01F 1/0022* (2013.01); *B01F 13/004* (2013.01); *B01F 15/0283* (2013.01); *B01F 2001/0088* (2013.01); *B01F 2215/0081* (2013.01); *E21B 43/26* (2013.01)

(58) Field of Classification Search

CPC ..... B01F 5/10; B01F 1/0022; B01F 13/004; B01F 15/0283; B01F 2001/0088; B01F 2215/0081; E21B 43/26

See application file for complete search history.

(56) References Cited

U.S. PATENT DOCUMENTS

| | | | | |
|---|---|---|---|---|
| 3,724,551 | A | 4/1973 | Troscinski et al. | |
| 4,395,340 | A | 7/1983 | McLaughlin | |
| 4,599,182 | A | 7/1986 | Young et al. | |
| 4,603,154 | A | 7/1986 | Luetzelschwab | |
| 4,841,218 | A * | 6/1989 | Rosinnes | H02P 9/44 322/24 |
| 4,882,009 | A | 11/1989 | Santoleri et al. | |
| 5,711,376 | A | 1/1998 | Sydansk | |
| 6,736,153 | B1 | 5/2004 | Kime | |

(Continued)

OTHER PUBLICATIONS

BrineMaker, Your One-Stop Source for High Performance Briner Solutons, Brine Make-up & Storage System, 1 page.

*Primary Examiner* — Aaron L Lembo

(74) *Attorney, Agent, or Firm* — TraskBritt

(57) ABSTRACT

A method of providing a salt solution at a wellbore site includes delivering solid salt in a mixing tank containing water from a local source and pumping the water through nozzles in the mixing tank using a pump adjacent to the mixing tank to circulate the water in the mixing tank and form a concentrated brine by dissolving the solid salt in the water. The concentrated brine is transferred from the mixing tank to a reservoir using the pump, and the concentrated brine is diluted with additional water from the local source to form a dilute brine. A related mixing tank and a system including the mixing tank and a vehicle structured and configured for travel over a roadway and within an oilfield site.

20 Claims, 2 Drawing Sheets

(56) References Cited

U.S. PATENT DOCUMENTS

| | | | | |
|---|---|---|---|---|
| 8,733,442 | B1 * | 5/2014 | Smith | C09K 8/80 166/305.1 |
| 10,052,624 | B2 * | 8/2018 | Menon | A61M 1/1696 |
| 10,544,340 | B2 * | 1/2020 | Nesheim | B01F 1/0022 |
| 10,676,663 | B2 * | 6/2020 | Breedlove | C09K 8/03 |
| 2003/0052060 | A1 | 3/2003 | Teel | |
| 2005/0189216 | A1 * | 9/2005 | Krylov | C02F 1/4674 204/263 |
| 2012/0000840 | A1 | 1/2012 | Malmquist | |
| 2012/0043268 | A1 * | 2/2012 | Chen | C02F 1/22 210/175 |
| 2013/0233542 | A1 | 9/2013 | Shampine et al. | |
| 2017/0233264 | A1 * | 8/2017 | Boylan | C02F 1/048 203/10 |

* cited by examiner

METHOD FOR PROVIDING BRINE

CROSS-REFERENCE TO RELATED APPLICATION

This application claims the benefit under 35 U.S.C. § 119(e) of U.S. Provisional Patent Application Ser. No. 62/655,609, filed Apr. 10, 2018, and entitled "METHOD AND SYSTEM FOR PROVIDING BRINE," the disclosure of which is hereby incorporated herein in its entirety by this reference.

FIELD

Embodiments of the present disclosure relate generally to preparation and delivery of brine such as, for example, for use in oilfield operations.

BACKGROUND

Hydraulic fracturing, or "fracking," is used to improve extraction of hydrocarbon materials (e.g., crude oil, natural gas, condensates, etc.) from subsurface geologic formations by fracturing formations with pressurized liquid. In such operations, 2,100,000 to 21,000,000 gallons of fluid with chemical additives and proppants (usually sand) are injected into formations under high rates and pressures to fracture the rock. The proppants fill the fractures and keep them open after fracking operations are completed, providing a path for hydrocarbons to travel through the rock to an extraction well. Brines maybe used during drilling or fracking operations in geologic formations that contain clays that are highly sensitive to fresh water. One purpose of adding brines is to treat reactive clays by modifying the chemistry, which inhibits them from swelling and clogging up the fractures so hydrocarbons can migrate to the surface. Brines for such operations typically contain dissolved KCl (potassium chloride). The brine is mixed to a certain concentration and chemistry tailored to the clay type and concentration to minimize the harmful effects of water-sensitive clays.

Oilfield operations using brine are typically supplied with the brine from a remote mix facility, where the brine is prepared to the customer's (e.g., the well operator's) specifications by mixing solid salt(s) (e.g., KCl, NaCl, etc.) with water. The brine is transported to the wellbore site by tank trucks. During drilling and fracking operations, several hundred truck deliveries may be required to transport the required brine to the site complicating the operations and adding considerable expense to the operator. Additionally, hauling water long distances in inclement weather increases safety risks and the potential for operational failures. Varying concentrations of brine may be provided during the life of the well depending on the properties of the subsurface geologic formations. Brine may also be used for other oilfield operations and may have other materials added to it, such as polymers, surfactants, proppants (e.g., sand), acids, friction reducers, etc., when employed in such other operations.

BRIEF SUMMARY

In some embodiments, a method of providing a salt solution at a wellbore site includes delivering (e.g., blowing) a solid salt into a mixing tank containing water from a local source; pumping the water through a plurality of nozzles in the mixing tank using a pump adjacent to the mixing tank to circulate the water in the mixing tank and form a concentrated brine by dissolving the solid salt in the water. The concentrated brine is transferred from the mixing tank to a reservoir, such as a series of 500-barrel tanks, using the pump. The concentrated brine is later diluted with water from the local source to form a dilute brine, which may be stored in an additional series of 500-barrel tanks.

A system for providing a salt solution from a solid salt at a wellbore site includes a mixing tank and a vehicle structured and configured for travel over a roadway and within an oilfield site. The mixing tank is structured and configured to receive water and solid salt, and contains a plurality of nozzles structured and configured to dissolve the solid salt in the water to form the concentrated brine. The vehicle is configured to transport at least one pump configured to circulate water from the mixing tank through the nozzles and to transfer the concentrated brine from the mixing tank to the reservoir after the solid salt is dissolved.

A mixing tank for forming a salt solution includes an outer wall defining an interior volume of the mixing tank; a fluid outlet in fluid communication with the interior volume; a plurality of nozzles arranged along the outer wall inside the interior volume and in fluid communication with the interior volume; a fluid inlet in fluid communication with the nozzles; and a solid inlet configured to provide a powdered solid salt at the top of the volume over the fluid outlet.

DETAILED DESCRIPTION

The illustrations presented herein are not actual views of any particular system or method, but are merely idealized representations that are employed to describe example embodiments of the present disclosure.

As used herein, the singular forms "a," "an," and "the" are intended to include the plural forms as well, unless the context clearly indicates otherwise.

As used herein, "and/or" includes any and all combinations of one or more of the associated listed items.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features and methods usable in combination therewith should or must be excluded.

As used herein, any relational term, such as "first," "second," "top," "bottom," "lower," "bottom," "above," "upper," "top," "front," "rear," "left," "right," etc., is used for clarity and convenience in understanding the disclosure and accompanying drawings, and does not connote or depend on any specific preference, orientation, or order, except where the context clearly indicates otherwise.

As used herein, the terms "comprises," "comprising," "includes," and/or "including" specify the presence of stated features, regions, stages, operations, elements, materials, components, and/or groups, but do not preclude the presence or addition of one or more other features, regions, stages, operations, elements, materials, components, and/or groups thereof.

As used herein, the term "configured" refers to a size, shape, material composition, and arrangement of one or more of at least one structure and at least one apparatus facilitating operation of one or more of the structures and the apparatus in a predetermined way.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" used in reference to a given parameter is inclusive of the stated value and has the meaning dictated by the context (e.g., it includes the degree of error associated with measurement of the given parameter).

As used herein, the term "brine" means and includes a saline solution formed by dissolving salt in water. The terms "concentrated brine" and "dilute brine" are relative terms used for convenience and clarity herein, and are not limited to any particular salt concentrations.

Figure 1:
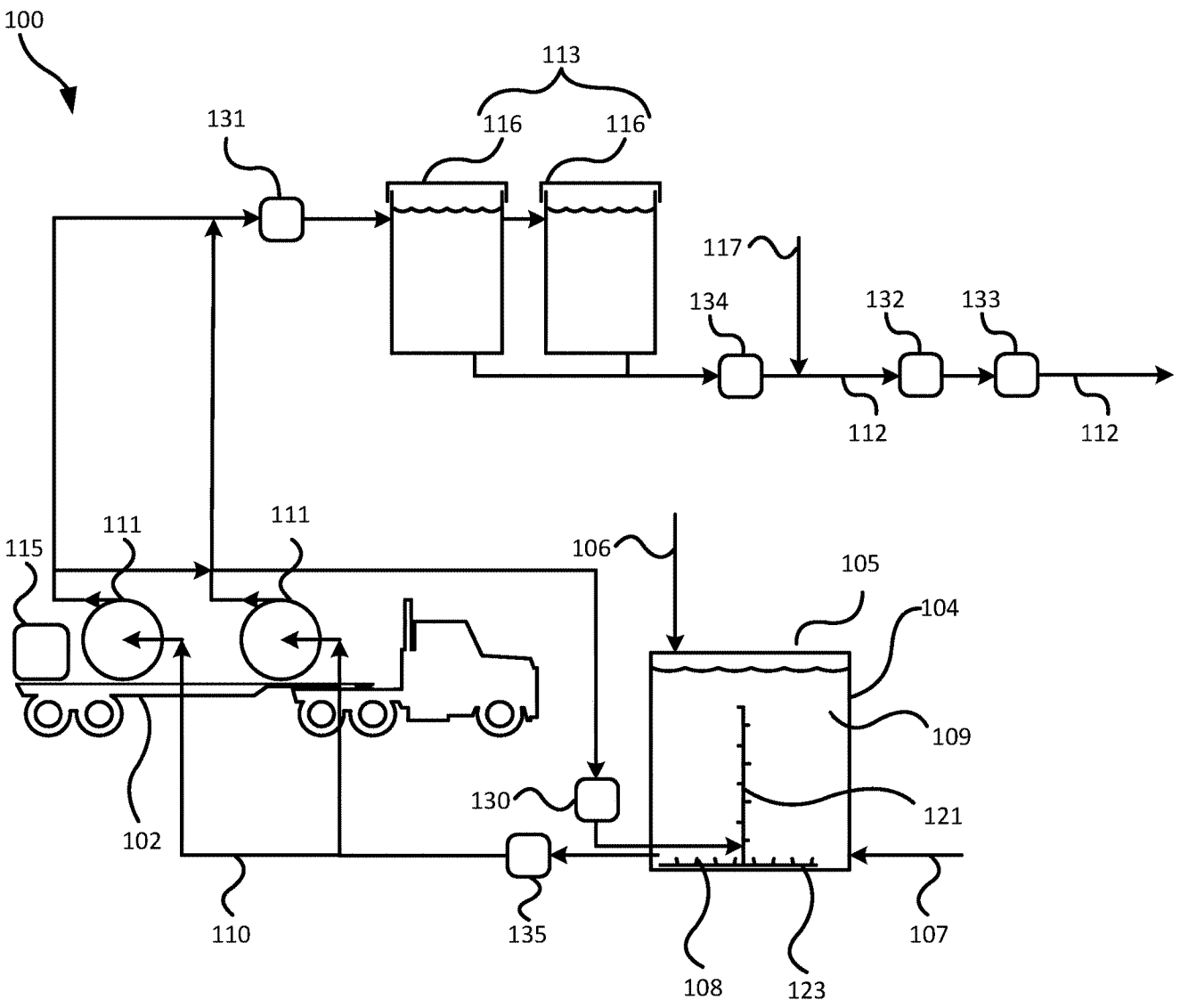
FIG. 1 is a simplified view illustrating an embodiment of a system for providing a potassium salt solution according to the present disclosure.

FIG. 1 is a simplified side view of a system 100 for providing a salt solution at a wellbore site. The system 100 includes a vehicle 102 structured and configured for travel over a roadway and within an oilfield site. In some embodiments, the vehicle 102 may include a trailer, which may be connected to a standard tractor unit (i.e., a semi). In certain embodiments, the vehicle 102 may be a truck having a diesel or gasoline engine operable to convey the vehicle 102 over the roadway and within the oilfield. For example, the vehicle 102 may be a flat-bed truck or trailer. In some embodiments, the vehicle 102 may be a medium-duty commercial truck or may be towable by a medium-duty commercial truck.

The vehicle 102 may carry one or more pumps 111 configured to circulate fluid to and from a mixing tank 104 through nozzles 108 in the mixing tank 104 and to transfer brine from the mixing tank 104 to a reservoir 113. The pumps 111 may be any pumps capable of transferring a selected flow rate of fluid (e.g., water or brine). For example, the pumps 111 may be capable of transferring from about 5 gallons per minute to about 3000 gallons per minute. In some embodiments, the pumps 111 may be positive-displacement or centrifugal pumps, and may be driven by a gasoline or diesel engine, or by electricity from a power source, such as generator 115 located on the vehicle 102. Though FIG. 1 illustrates two pumps 111, any number of pumps may be carried on the vehicle 102. In embodiments in which the system 100 includes two or more pumps 111, the pumps 111 may operate independently of one another. That is, by controlling one or more valves, one pump 111 or the other may be used, or both may be used concurrently. The use of one pump 111 as a backup may enable use of the system 100 uninterrupted even if one of the pumps 111 becomes inoperable. Such an arrangement may increase the reliability of the system 100 (e.g., increase the time between failures requiring shut down or decrease the total time during which the system 100 is shut down).

Figure 2:
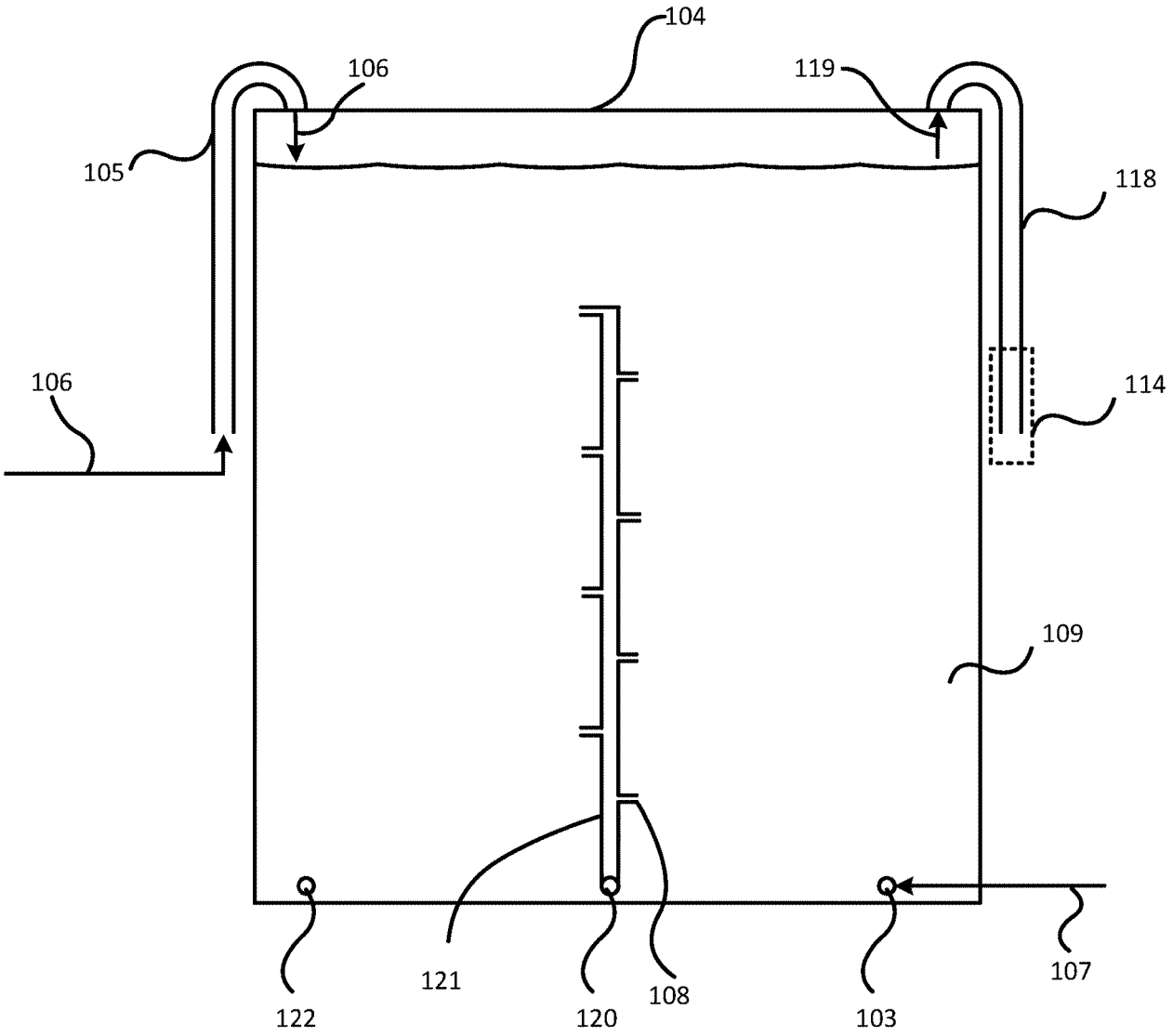
FIG. 2 is a simplified view illustrating a mixing tank that may be used in the system illustrated in FIG. 1.

The mixing tank 104, shown in more detail in FIG. 2, may include at least one outer wall, such as a cylindrical lateral wall, a base, and a top. The mixing tank 104 may be structured and configured to receive water 107 through a water inlet 103 and a solid 106 (e.g., a powdered potassium salt) through a solid inlet 105 to form a concentrated brine 109 inside the mixing tank 104. In some embodiments, one of the pumps 111 may be used to pump the water 107 from a water source into the mixing tank 104. The mixing tank 104 may be located adjacent to the vehicle 102 (FIG. 1) such that the pumps 111 may be connected to the mixing tank 104 by hoses or piping 110. In some embodiments, the mixing tank 104 may include a dust vent 118 and filter 114 to permit air to leave the mixing tank 104 while trapping the escape of particulate solid material (e.g., dust) to the atmosphere. For example, in some embodiments, the solid 106 may be added to the mixing tank 104 by blowing air with the solid 106 entrained therein through the solid inlet 105 into the top of the mixing tank 104. The solid 106 may generally fall downward in the mixing tank (and may be directed downward by the shape and orientation of the solid inlet 105), and excess air 119 may escape through the dust vent 118 and filter 114. The filter 114 may be, for example, a sock filter, a pleated paper filter, or any other selected filter.

The nozzles 108 in the mixing tank 104 may be arranged along one or more outer walls of the mixing tank 104 and connected to the output of the pumps 111. For example, the nozzles 108 may be connected via a fluid inlet 120 to a pipe 121 parallel to a lateral side of the mixing tank 104 and/or a pipe 123 (FIG. 1) parallel to a base of the mixing tank 104. Some of the nozzles 108 may be oriented in opposite directions inducing agitation to cause fluid flow in multiple directions and cause mixing of the solid 106 and the water 107 in the mixing tank 104. For example, some of the nozzles 108 along the lateral side of the mixing tank may be oriented such that they direct fluid flow clockwise, and other nozzles 108 may be oriented such that they direct fluid flow counterclockwise. The opposite fluid flow directions tend to promote turbulent mixing and dissolution of the solid 106 in the water 107 to form the concentrated brine 109 within the mixing tank 104.

The solid inlet 105 may be arranged such that the solid 106 is delivered to the mixing tank 104 directly above or nearly directly above a fluid outlet 122 connected to a pump suction line (e.g., as part of the piping 110 shown in FIG. 1). The pumps 111 (FIG. 1) may continuously draw water 107 from the mixing tank 104 through the fluid outlet 122 and piping 110, then back to the mixing tank 104 through the fluid inlet 120 and nozzles 108 while the solid 106 is added. The continuous flow of the water 107 and the location of the fluid outlet 122 may limit the extent to which the solid 106 forms a stagnant pile of solid material in the mixing tank 104. Furthermore, the solid 106 may fall in the water 107 before reaching the base of the mixing tank 104, providing time for the solid 106 to dissolve as it settles. Thus, the solid 106 may be partially dissolved and/or suspended in the water 107 before reaching the fluid outlet 122, and may be pulled through the pumps 111 with the water 107. This circulation of the water 107 and the solid 106 may cause the solid 106 to dissolve rapidly as the mixing tank is filled with the water 107 and the solid 106. A hydrometer 130 or other density meter may measure the specific gravity of the water 107 entering the mixing tank 104 from the pumps 111 to determine the concentration of the solid 106 dissolved therein. In some embodiments, another device, such as a conductivity detector, may be used instead of the hydrometer 130 to determine the concentration of the solid 106. A flowmeter 135 may measure the flow rate of the water through the pumps 111.

The mixing tank 104 may have any selected capacity, such as from about 500 gallons to about 70,000 gallons, or from about 1,000 gallons to about 20,000 gallons. The capacity of the mixing tank 104 may be selected such that the mixing tank 104 may be transported by a conventional truck or trailer over public highways. For example, the mixing tank 104 may be a 400-barrel (16,800 gallon) vertical polyethylene or metal tank. In some embodiments, the circulation of fluid through the pumps 111 and the mixing tank 104 continues until all the solid 106 has been added and dissolved in the water 107. The pumps 111 may be turned off when the mixing tank 104 is approximately full of the concentrated brine 109. In other embodiments, one pump 111 may continue to circulate the concentrated brine 109 while another pump 111 transfers portions of the concentrated brine 109 to the reservoir 113. For example, the piping 110 may include a valve manifold configured to direct flow of the concentrated brine 109 to the mixing tank 104 or to the reservoir 113. The concentrated brine 109 entering the reservoir 113 may pass through a flowmeter 131 to continuously measure the amount of concentrated brine 109 delivered. This may simplify operations by enabling an operator to quickly determine the volume of concentrated brine 109 available at any time and by automating billing (e.g., by continuously reporting the volume of concentrated brine 109 delivered to a computer that generates billing reports). Although FIG. 1 illustrates that the system 100 includes one mixing tank 104, the disclosure is not so limited. In other embodiments, the system 100 may include at least two mixing tanks 104, at least three mixing tanks 104, or even at least four mixing tanks 104, depending on an amount of dilute brine 112 to be formed. In some such embodiments, the mixing tanks 104 may be connected in series or in parallel to the pump 111.

The reservoir 113 may include one or more storage tanks 116 (two are pictured in FIG. 1) configured to receive the concentrated brine 109. Typically, the reservoir 113 may include four or five storage tanks 116, each configured to contain about 500 barrels (21,000 gallons). The concentrated brine 109 may be stored in the reservoir 113 until needed. The concentrated brine 109 may be drawn from the reservoir 113 and mixed with water 117 to form a dilute brine 112 of a selected concentration. The dilute brine 112 may typically flow to one or more holding tanks (e.g., a bank of "frack tanks") for use in an oilfield or other operation. The dilute brine 112 may pass through a hydrometer 132 and/or a flowmeter 133 to track the volume and concentration of the dilute brine 112 delivered. The hydrometers 130, 132 and flowmeters 131, 133 (or any combination thereof) may continuously transmit data (for example, via wired or wireless connections) to a computer configured to perform process controls, alerts, billing, or any other function. Another measurement device 134 (e.g., a hydrometer, a flow meter, or a combination of both) may be used to measure the concentrated brine 109 and better control the concentration of the dilute brine 112 (e.g., by adjusting the flow of the concentrated brine 109, the water 117, or both).

The system 100 may be used to provide a salt solution at a wellbore site or any other location having an available water supply. The salt may include a potassium salt such as potassium chloride, a sodium salt, a calcium salt, a sulfate, a phosphate, etc., or any combination thereof. The salt may be transported to the wellbore site (which may be a remote site from the source of the salt) by a dedicated transport truck or by the vehicle 102. For example, the salt may be loaded onto the vehicle 102 with the pumps 111, or may be carried on a separate trailer.

The salt may be mixed with water from a local source at the wellbore site in the mixing tank 104, typically by passing the water 107 and/or solid 106 through the nozzles 108. The resulting concentrated brine 109 may have a salt concentration of at least about 15% by weight (150 parts per thousand (ppt)), at least about 18% by weight (180 ppt), or even at least about 20% by weight (200 ppt). In some embodiments, the concentrated brine 109 may be saturated or nearly saturated with the salt. A mixing time of the water and salt may be selected based on the fresh water chemistry (based on the water 107 from a local source), solubility of the salt in water at the temperature of the water and on a weight percent of the salt in the bulk product. These properties of the fresh water chemistry may be determined by conventional techniques. For example, potassium chloride has a solubility in water at 20° C. of about 25.4% (254 ppt), and a solubility in water at 0° C. of about 21.7% (217 ppt). Thus, if the concentrated brine 109 is saturated with potassium chloride, the concentration of potassium chloride may be in a range from about 21% (210 ppt) to about 26% (260 ppt) at common operating temperatures. In some embodiments, the concentrated brine 109 may be substantially free of solids, and the salt concentration may be selected to be slightly below the solubility limit of the salt to prevent recrystallization in the mixing tank 104. For example, the concentration of potassium chloride may be in a range from about 20% (200 ppt) to about 25% (250 ppt), depending on the expected range of ambient operating temperatures of the system 100. In some embodiments, the resulting concentrated brine 109 may have a salt concentration (e.g., a concentration of KCl) such that the concentrated brine 109 has a specific gravity of at least about 1.097 (i.e., about 1.097 $g/cm^3$; about 164.2 kg $KCl/m^3$), a specific gravity of at least about 1.119 (e.g., about 1.119 $g/cm^3$; about 226.0 kg $KCl/m^3$), a specific gravity of at least about 1.133 (i.e., about 1.133 $g/cm^3$; about 226.0 kg $KCl/m^3$), or even a specific gravity of at least about 1.162 (i.e., about 1.162 $g/cm^3$; about 278.2 kg $KCl/m^3$). In some embodiments, the specific gravity values of the concentrated brine 109 are based on the concentration of KCl in water. In other words, in some such embodiments, the specific gravity may be due to the presence of substantially only the KCl in the water. The concentration of the potassium chloride in the concentrated brine 109 may be in a range from about 15% by density to about 24% by density at common operating temperatures such that the concentrated brine 109 has a specific gravity within a range from about 1.097 to about 1.162. By way of nonlimiting example, the concentrated brine 109 may include between about 164.2 kg $KCl/m^3$ and about 278.2 kg $KCl/m^3$, such as between about 164.2 kg $KCl/m^3$ and about 226.0 kg $KCl/m^3$, or between about 226.0 kg $KCl/m^3$ and about 278.2 kg $KCl/m^3$. Of course, it will be understood that the KCl may be dissolved within solution and be present in the form of potassium ions and chloride ions. In some embodiments, depending on a purity of the KCl, the concentrated brine 109 may have a density within a range from about 70 pounds per barrel to about 100 pounds per barrel, such as from about 70 pounds per barrel to about 80 pounds per barrel, from about 80 pounds per barrel to about 90 pounds per barrel, or from about 90 pounds per barrel to about 100 pounds per barrel.

In some embodiments, the water 107 may be heated, which may reduce a likelihood of freezing of the water 107 in the system 100 (e.g., in the mixing tank 104, in the piping 110). By way of nonlimiting example, the water 107 may be heated to a temperature greater than about 5° C., greater than about 20° C., greater than about 25° C., greater than about 40° C., greater than about 50° C., greater than about 60° C., greater than about 70° C., or even greater than about 80° C. In some embodiments, the water 107 is heated to a temperature less than about 80° C.

The concentrated brine 109 may be diluted by mixing with water 117 from the local source (which may be the same as the water 107 used to form the concentrated brine 109, but may be drawn from a different hose or tap) to form the dilute brine 112. The concentrated brine may also be pulled directly by the fracking company into their equipment and diluted down during fracking operations. The mixing may be performed as the concentrated brine 109 leaves the reservoir 113, described above. The resulting dilute brine 112 may have a salt concentration of less than about 5% by weight (50 parts per thousand (ppt)), such as less than about 3.5% by weight (35 ppt). For example, the dilute brine 112 may have a salt concentration of about 2% by weight (20 ppt) or about 3% by weight (30 ppt). In some embodiments, the dilute brine 112 may have a salt concentration such that the dilute brine has a specific gravity within a range from about 1.005 (i.e., about 1.005 g/cm$^3$) to about 1.043 (i.e., about 1.043 g/cm$^3$), such as between about 1.011 (i.e., about 1.011 g/cm$^3$) and about 1.024 (i.e., about 1.024 g/cm$^3$). In some such embodiments, the dilute brine 112 may have a salt concentration within a range from about 1% by density to about 7% by density. In some embodiments, the dilute brine 112 may include between about 10.0 kg/m$^3$ and about 73.0 kg/m$^3$, such as between about 20.2 kg KCl/m$^3$ and about 41.0 kg KCl/m$^3$. The concentration of KCl in the diluted brine 112 may be less than about 51.3 kg KCl/m$^3$, less than about 41.0 kg KCl/m$^3$, less than about 30.5 kg KCl/m$^3$, or even less than about 20.2 kg KCl/m$^3$. The concentration of the dilute brine 112 may be adjusted to meet the needs of the well operator. In some embodiments, the concentration of the dilute brine 112 may be adjusted on-site during an oilfield operation as conditions change (e.g., the operator determines during the operation that the previously selected concentration of brine should be increased or decreased), an option that may be unavailable or difficult to implement in conventional processes (e.g., delivery of brine of a preselected concentration by tank trucks).

The dilute brine 112 may be transferred from the reservoir 113 to holding tanks, where it may remain until needed for injection to a wellbore or other location. In some embodiments and for various types of oilfield operations, the dilute brine 112 may be mixed with other materials, such as polymers, surfactants, proppants (e.g., sand), acids, friction reducers, etc.

By diluting the concentrated brine 109 with the water 117 leaving the reservoir 113, the system 100 may be capable of delivering a much larger volume of dilute brine 112 than can be carried by a conventional brine-hauling vehicle or stored in the mixing tank 104 alone. For example, in some embodiments, the system 100 may be capable of delivering from about five times to about twenty times the volume of dilute brine 112 as compared to the capacity of the mixing tank 104. In some embodiments, the system 100 may be capable of delivering at least about 10,000 gallons, at least about 20,000 gallons, at least about 50,000 gallons, at least about 100,000 gallons, or even at least about 200,000 gallons of dilute brine 112 before refilling the reservoir 113 using the mixing tank 104, the pumps 111, and additional solid potassium salt and water. This may enable operation of the system 100 with less labor, because a single operator may monitor and control the pumps 111, without needing to stop and reload the mixing tank 104. Furthermore, the operator may build an inventory of the dilute brine 112 between fracking stages so that a large volume of the dilute brine 112 is ready when needed. The reservoir 113 may continuously provide dilute brine 112 to the holding tank while the operator is not on site (e.g., during the operator's rest time, such as overnight). In addition to the pumps 111 and the generator 115, the vehicle 102 may also carry other equipment, such as tool boxes, lighting, plumbing, etc., which may enable the operator to have a complete system on the vehicle 102 (other than the mixing tank 104 and the reservoir 113).

Furthermore, the use of a local water supply on-site may decrease the mass of material to be transported to an oilfield drilling site and/or the need for waste treatment. For example, salt transported to the site on one or two vehicles may provide sufficient brine to meet the entire needs of a site if the salt is transported to the site in solid form. That is, the salt may be transported to the site without any significant amount of water. This may simplify transport and reduce the costs and risks associated with providing the salt. The process of making the brine may use water that would otherwise not have been used at the site, or water that has already been used for another purpose (e.g., cooling water), and so may decrease the amount of wastewater that must be treated to meet regulatory requirements.

The design of the system 100 may eliminate offsite mixing and enable an operator to perform all mixing onsite at the well to improve efficiency, safety, and costs.

Additional non-limiting example embodiments of the disclosure are described below.

Embodiment 1

A method of providing a salt solution at a wellbore site. The method comprises delivering a solid salt into a mixing tank containing water from a local source; pumping the water through a plurality of nozzles in the mixing tank using a pump adjacent to the mixing tank to circulate the water in the mixing tank and form a concentrated brine by dissolving the solid salt in the water; transferring the concentrated brine from the mixing tank to a reservoir using the pump; and diluting the concentrated brine with additional water from the local source to form a dilute brine.

Embodiment 2

The method of Embodiment 1, wherein pumping the water through a plurality of nozzles comprises forming a concentrated brine from a solid potassium salt, the concentrated brine having a salt concentration of at least 15% by weight.

Embodiment 3

The method of Embodiment 2, pumping the water through a plurality of nozzles comprises forming a concentrated brine from the solid potassium salt, the concentrated brine having a salt concentration of at least 18% by weight.

Embodiment 4

The method of any of Embodiments 1 through 3, wherein pumping the water through a plurality of nozzles comprises forming a concentrated brine from the solid potassium salt, the concentrated brine substantially saturated with the potassium salt.

Embodiment 5

The method of any of Embodiments 1 through 4, wherein pumping the water through a plurality of nozzles comprises forming a solution substantially free of solids.

Embodiment 6

The method of any of Embodiments 1 through 5, wherein diluting the concentrated brine comprises forming a dilute brine having a salt concentration of less than 5% by weight.

Embodiment 7

The method of Embodiment 6, wherein diluting the concentrated brine comprises forming a dilute brine having a salt concentration of less than 3.5% by weight.

Embodiment 8

The method of any of Embodiments 1 through 7, wherein delivering a solid salt into a mixing tank containing water from a local source comprises delivering potassium chloride into the mixing tank.

Embodiment 9

The method of any of Embodiments 1 through 8, further comprising injecting the dilute brine into a wellbore.

Embodiment 10

The method of any of Embodiments 1 through 9, further comprising transporting the solid salt to the wellbore site.

Embodiment 11

A system for providing a salt solution from a solid salt at a wellbore site. The system comprises a mixing tank and a vehicle structured and configured for travel over a roadway and within an oilfield site. The mixing tank is structured and configured to receive water and a solid salt, and contains a plurality of nozzles structured and configured to circulate the water in the mixing tank to dissolve the solid salt in the water to form the concentrated brine. The vehicle is configured to transport at least one pump configured to circulate water from the mixing tank through the nozzles and to transfer the concentrated brine from the mixing tank to the reservoir after the solid salt is dissolved.

Embodiment 12

The system of Embodiment 11, further comprising a hydrometer configured to measure a density of the concentrated brine transferred to the reservoir.

Embodiment 13

The system of Embodiment 11 or Embodiment 12, further comprising a flowmeter configured to measure an amount of the concentrated brine transferred to the reservoir.

Embodiment 14

The system of any of Embodiments 11 through 13, wherein the vehicle comprises a trailer.

Embodiment 15

The system of any of Embodiments 11 through 14, wherein the vehicle comprises a diesel engine operable to convey the vehicle.

Embodiment 16

The system of any of Embodiments 11 through 15, wherein the mixing tank has a capacity from about 500 gallons to about 50,000 gallons.

Embodiment 17

The system of any of Embodiments 11 through 16, wherein the system is sized and configured to deliver at least about 100,000 gallons of a dilute brine before the mixing tank receives additional solid salt.

Embodiment 18

The system of any of Embodiments 11 through 17, wherein the at least one pump comprises at least two pumps configured to operate independently.

Embodiment 19

The system of any of Embodiments 11 through 18, further comprising a generator on the vehicle, the generator configured to provide power to the at least one pump.

Embodiment 20

The system of any of Embodiments 11 through 19, further comprising a filter to limit escape of particulate solid salt outside the mixing tank.

Embodiment 21

The system of any of Embodiments 11 through 20, wherein the reservoir comprises a plurality of tanks.

Embodiment 22

A mixing tank for forming a salt solution, the mixing tank comprising an outer wall defining an interior volume of the mixing tank; a fluid outlet in fluid communication with the interior volume; a plurality of nozzles arranged along the outer wall inside the interior volume and in fluid communication with the interior volume; a fluid inlet in fluid communication with the nozzles; and a solid inlet configured to provide powder at a top of the volume over the fluid outlet.

Embodiment 23

The mixing tank of Embodiment 22, further comprising a dust vent and filter to permit gases to flow from the interior volume while limiting escape of particulate solids from the interior volume.

Embodiment 24

The mixing tank of Embodiment 22 or Embodiment 23, wherein nozzles of the plurality of nozzles are oriented in opposite directions along a lateral portion of the outer wall.

Embodiment 25

The mixing tank of any of Embodiments 22 through 24, wherein the outer wall comprises a generally planar base, and wherein nozzles of the plurality of nozzles are oriented in opposite directions along the base.

While the present invention has been described herein with respect to certain illustrated embodiments, those of ordinary skill in the art will recognize and appreciate that it is not so limited. Rather, many additions, deletions, and modifications to the illustrated embodiments may be made without departing from the scope of the invention as hereinafter claimed, including legal equivalents thereof. In addition, features from one embodiment may be combined with features of another embodiment while still being encompassed within the scope of the invention as contemplated by the inventors. Further, embodiments of the disclosure have utility with different and various brine compositions.

What is claimed is:

1. A method of providing a salt solution at a wellbore site, the method comprising:

delivering a solid salt into a mixing tank containing water from a local source;

pumping the water through a plurality of nozzles in the mixing tank using a pump adjacent to the mixing tank to circulate the water in the mixing tank and form a concentrated brine by dissolving the solid salt in the water;

transferring the concentrated brine from the mixing tank to a reservoir using the pump; and after transferring the concentrated brine from the mixing tank to the reservoir, mixing the concentrated brine with additional water from the local source to dilute the concentrated brine and form a dilute brine.

2. The method of claim 1, wherein pumping the water through the plurality of nozzles comprises forming the concentrated brine from a solid potassium salt, the concentrated brine having a salt concentration of at least about 164.2 kg $KCl/m^3$.

3. The method of claim 2, wherein pumping the water through the plurality of nozzles comprises forming the concentrated brine from the solid potassium salt, the concentrated brine having a salt concentration of at least about 226.0 kg $KCl/m^3$.

4. The method of claim 1, wherein pumping the water through the plurality of nozzles comprises forming the concentrated brine from a solid potassium salt, the concentrated brine substantially saturated with the potassium salt.

5. The method of claim 1, wherein pumping the water through the plurality of nozzles comprises forming a solution substantially free of solids.

6. The method of claim 1, wherein diluting the concentrated brine comprises forming the dilute brine having a salt concentration of less than about 51.3 kg $KCl/m^3$.

7. The method of claim 6, wherein diluting the concentrated brine comprises forming the dilute brine having a salt concentration of less than about 41.0 kg $KCl/m^3$.

8. The method of claim 1, wherein delivering the solid salt into the mixing tank containing water from the local source comprises delivering potassium chloride into the mixing tank.

9. The method of claim 1, further comprising transporting the solid salt to the wellbore site.

10. The method of claim 1, wherein delivering the solid salt into the mixing tank containing water from the local source comprises: introducing, into the mixing tank, the solid salt entrained in air; and removing excess air from the mixing tank through a dust vent, the dust vent comprising a filter configured to capture particulate solid material.

11. The method of claim 1, wherein pumping the water through the plurality of nozzles in the mixing tank using the pump adjacent to the mixing tank to circulate the water in the mixing tank and form the concentrated brine by dissolving the solid salt in the water comprises pumping water through a plurality of nozzles including nozzles parallel to a lateral side of the mixing tank and nozzles parallel to a base of the mixing tank, the lateral side substantially perpendicular to the base.

12. The method of claim 1, wherein pumping the water through the plurality of nozzles in the mixing tank using the pump adjacent to the mixing tank to circulate the water in the mixing tank and form the concentrated brine by dissolving the solid salt in the water comprises pumping the water into some nozzles configured to direct fluid flow clockwise and pumping the water into other nozzles configured to direct the fluid flow counterclockwise.

13. The method of claim 1, wherein pumping the water through the plurality of nozzles in the mixing tank using the pump adjacent to the mixing tank to circulate the water in the mixing tank and form the concentrated brine by dissolving the solid salt in the water comprises pumping the water out of the mixing tank through a fluid outlet and back into the mixing tank through a fluid inlet while delivering the solid salt into the mixing tank.

14. The method of claim 12, further comprising measuring a specific gravity of the water entering the mixing tank through a fluid inlet.

15. The method of claim 1, wherein delivering the solid salt into the mixing tank containing water from the local source comprises forming the concentrated brine from a solid potassium salt, the concentrated brine having a salt concentration from about 21 percent by weight to about 26 percent by weight.

16. The method of claim 1, wherein delivering the solid salt into the mixing tank containing water from the local source comprises forming the concentrated brine from a solid potassium salt, the concentrated brine having a salt concentration of at least about 20 percent by weight.

17. The method of claim 1, further comprising heating the water in the mixing tank.

18. The method of claim 1, wherein diluting the concentrated brine with additional water from the local source to form the dilute brine comprises forming the dilute brine to have a density within a range from about 1.005 $g/cm^3$ to about 1.024 $g/cm^3$.

19. The method of claim 1, wherein:

forming the concentrated brine comprises forming the concentrated brine to comprise a salt concentration of at least about 20 percent by weight; and diluting the concentrated brine with additional water from the local source to form the dilute brine comprises forming the dilute brine to comprise less than about 3.5 percent by weight of the salt.

20. A method of providing a salt solution at a wellbore site, the method comprising:

mixing a solid salt comprising potassium chloride with water from a local source;

pumping the water through a plurality of nozzles in a mixing tank using a pump adjacent to the mixing tank to circulate the water in the mixing tank and form a concentrated brine comprising at least about 164.2 kg $KCl/m^3$ by dissolving the solid salt in the water;

transferring the concentrated brine from the mixing tank to a reservoir using the pump; and after transferring the concentrated brine to the reservoir, diluting the concentrated brine from the reservoir with additional water from the local source to form a dilute brine.

* * * * *